US005404830A

United States Patent [19]

Ligozio

[11] Patent Number: 5,404,830

[45] Date of Patent: Apr. 11, 1995

[54] FINNED BOAT HULL

[76] Inventor: Peter A. Ligozio, 6643 Wolcott St., Red Creek, N.Y. 13143

[21] Appl. No.: 108,774

[22] Filed: Jul. 27, 1993

Related U.S. Application Data

[63] Continuation of Ser. No. 881,781, May 11, 1992, abandoned.

[51] Int. Cl.[6] ..... B63B 1/30

[52] U.S. Cl. ..... 114/282; 114/280; 114/284

[58] Field of Search ..... 114/274, 278, 280, 282, 114/284, 288, 290, 291; 440/68–70; D12/311, 313, 314

[56] References Cited

U.S. PATENT DOCUMENTS

| | | | |
|---|---|---|---|
| 638,463 | 12/1899 | Just | 114/20 R |
| 1,073,100 | 9/1913 | Davison | 114/282 |
| 1,223,616 | 4/1917 | Riecks | 114/282 |
| 2,929,346 | 3/1960 | Perce | 114/282 |
| 2,980,047 | 4/1961 | Korganoff | 114/282 |
| 3,195,495 | 7/1965 | Erlandsen | 114/282 |
| 3,545,399 | 12/1970 | Adam | 114/282 |
| 3,802,369 | 4/1974 | Ishimoto | 114/282 |
| 3,881,438 | 5/1975 | Jones, Jr. | 114/56 |
| 3,911,846 | 10/1975 | England | 114/288 |
| 4,030,443 | 6/1977 | Price . | |
| 4,040,373 | 8/1977 | Jones, Jr. | 114/126 |
| 4,207,830 | 6/1980 | Wankel | 114/274 |
| 4,606,291 | 8/1986 | Hoppe | 114/61 |
| 4,665,853 | 5/1987 | Gerdsen et al. | 114/61 |
| 4,669,408 | 6/1987 | Schad | 114/284 |
| 4,702,188 | 10/1987 | Harilainen | 114/291 |

*Primary Examiner*—Robert J. Oberleitner
*Assistant Examiner*—Clifford T. Bartz
*Attorney, Agent, or Firm*—Eugene Stephens & Associates

[57] ABSTRACT

The invention is a displacement boat hull having the outboard surfaces of its wetted portion designed with a deep-V shape, and having at least one pair of retractable hydrofoil fins positioned in respective pockets along those outboard surfaces at a predetermined distance above the keel. When extended, the fins are positioned at fixed angles relative to the hull, and at least one pair of fins is positioned in proximity to the stern. In a preferred embodiment, a conventional deep-V semi-displacement hull is modified to increase the conventional maximum draft with an unusually steep angle (at least 30°–40°) for the initial deadrise from the keel upward toward the chine; and at least two pairs of fins are disposed on opposite sides of the hull, with an aft pair being positioned in proximity to the stern and another pair being positioned forward of the stern pair, preferably just forward of the boat's center of balance. The fins are continuously adjustable from (a) a fully-retracted in-pocket position to (b) a fully-extended position laterally outboard of the hull. The invention can be used to modify catamaran and tri-hulls as well as mono-hulls, and it is compatible with all types of propulsion systems. Such modifications provide a remarkably low center of gravity that assures excellent balance and stability at all times, particularly when operating with the fins, while achieving higher speeds and requiring less power.

17 Claims, 7 Drawing Sheets

FINNED BOAT HULL

This is continuation of patent application Ser. No. 881,781, filed 11 May 1992, by Peter A. Ligozio, entitled FINNED BOAT HULL, and abandoned upon the filing of this continuation application.

TECHNICAL FIELD

The invention relates to the design of boat hulls of the type utilizing hydrofoil vanes or fins for stability and/or for developing lift forces at higher speeds to assist in supporting the boat's weight.

BACKGROUND OF INVENTION

More than a century ago, submarines and torpedoes were designed with fins or wings for stability and/or for controlling the ascent and descent of hulls. More recently, "flying boats" have been designed with hydrofoils which support the entire weight of the vessel when it reaches operating speeds; and, in this regard, hydrofoil wings or fins have been adjustably positioned below the keels, or in the keels, of the standard hulls of water craft of all sizes, from one-person sport "scooters" (see U.S. Pat. No. 2,929,346 issued to G. E. Perce) all the way up to ocean freighters (see U.S. Pat. Nos. 3,881,438 and 4,040,373 issued to Allen Jones, Jr.) for the purpose of lifting such vessels up onto a plane. Further, such flying boats have also included fore and aft sets of fins for use as ailerons to control hull movement (see Perce, supra) and fixed, retractable swing wings (see U.S. Pat. No. 3,545,399 issued to Herbert A. Adam) positioned along the hull near the bow "for use in smooth inland waterways . . . to control pitch at high speed."

In addition to such flying boat designs in which hydrofoils are positioned below standard hulls, the prior art also includes "HYSUHULLS" in which hydrofoils are positioned along the underwater ("wetted") portion of a vessel's hull to develop lift forces for supporting only a portion of thee vessel's weight when higher speeds are attained. Such HYSUHULLS position at least one hydrofoil, or set of hydrofoil fins, as close as possible to the bottom of the hull. This design has apparently been most effective in catamaran-hulled small craft, the foils and fins being positioned in the tunnel between the hulls (see U.S. Pat. Nos. 4,606,291 and 4,665,853 issued, respectively, to Karl-Gunther W. Hoppe and Hans G. Gerdsen et al.).

With the exception of a few flying boat designs, the various prior art hull designs identified above have not proven technically feasible and/or commercially practicable and have not received wide acceptance by the boating community. Apparently, their planing designs, while quite fast, create safety problems related to (a) a dangerous loss of stability should their foils/fins strike floating objects, and (b) difficulty of operation requiring relatively complex controls and sophisticated operators. These problems are addressed by my invention.

SUMMARY OF THE INVENTION

The invention is described and claimed using terms that are well known in boat design technology. To facilitate understanding of the invention, the following definitions should be understood:

"Keel"—the longitudinal member extending along the bottom of the hull from stem to stern and supporting the entire frame. In most hulls, the bottom of the keel is positioned at the intersection of the hull's half-bottom planes at the centerline of the hull; however, in some vessels, like sail boats (see FIG. 6) the keel extends below the intersection of the hull's half-bottom planes. As used herein, the phrase "top of the keel" indicates the intersection of the hull's half-bottom planes at the centerline of the hull.

"Chine" is the intersection of each half-bottom plane with the side of the hull.

"Deadrise" is the angle of each half-bottom plane with the horizontal at the stern. Deadrise, while adding comfort to the ride and increasing steering control, also increases sensitivity to crosswinds and loading imbalance and increases drag on the hull. Conventional motorboat hull designs commonly use deadrise of 30+-8°.

"Deep-V" hull refers to the very successful hull originally designed by C. Raymond Hunt around 1950 for rough water racing and offshore fishing. The hull has a deep V-bottom carried from stem to stern, with an unusually steep deadrise (generally greater than 15°), and includes longitudinal strakes that aid stability. Persons engaged in the manufacture and design of "deep-V" motorboat hulls indicate that maximum deadrise for such hulls is 24°.

"Fins" are wing-like hydrofoils that extend, without external support, directly from the keel or hull of a watercraft in the same manner that the fins of a fish extend from its body.

My invention combines hydrofoil fins with a deep-V hull design modified to increase the conventional maximum deep-V draft with an unusually steep angle for the initial deadrise from the keel upward toward the chine. Namely, while presently known deep-V hulls have an initial deadrise angle of no more than 24° , my deep-V hull preferably has an initial deadrise angle of at least 24°, preferably 30°–40°. At least one pair of retractable fins is positioned in proximity to the stern in respective pockets along the outboard surfaces of the wetted portion of the hull at predetermined distances above the top of the keel.

In terms of hull design, this novel combination would seem counter-productive. That is, the purpose of hydrofoil fins is to increase planing speeds by creating greater lift to further reduce the wetted surface during planing, while the obvious effect of an extremely steep deadrise assures that more hull will remain in the water when planing. Nonetheless, the addition of selectively extendable and adjustable fins cantilevered to the wetted outboard portions of an extremely deep-V hull has produced remarkable results.

As can be seen in the drawings, my preferred hull designs include a plurality of relatively short, wing-like fins that can be extended in cantilever fashion from the wetted portion of the hull. At least two pairs of fins are disposed on opposite outboard surfaces of the hull, with an aft pair being positioned in proximity to the stern and another pair being positioned forward of the stern pair, preferably just forward of the boat's center of balance. The fins are continuously adjustable from (a) a fully-retracted position wherein the fins are positioned entirely within their respective pockets to (b) a fully-extended position wherein part of each fin extends laterally outboard of the hull above the keel for a predetermined maximum distance while a portion of the fin remains within its respective pocket.

Each of the fins is supported in a fixed angular orientation relative to the hull. This angular orientation, as well as the position of the fin pockets, is selected for each hull design according to expected vessel use. For most preferred embodiments, lift is facilitated by angling each fin upward, in a stern-to-bow direction, at an angle of 6°–10° from the horizontal. In addition, for higher speed use, one or more fin pairs are also angled upward, in an inboard-to-outboard direction, at an angle of 10°–25° from the horizontal; this latter angular orientation helps reentry to the surf in turns of high speed, and it also helps to prevent tripping.

Preferably, the fins have a delta shape and are pivotally mounted in their pockets, being rotated about the pivots for extension and retraction. However, they may also have circular or rectangular shapes, the leading edge of the delta or rectangular fins being swept backward when the fin is in its fully-extended position. Further, in preferred embodiments, the position of the fins is selectively controllable by the operator, permitting: (a) each fin to be individually positioned, (b) the port and starboard fins of each pair to be controlled simultaneously, or (c) the port and starboard fins of both the fore and aft pairs to be controlled simultaneously.

One preferred hull design includes at least two strake steps formed one above the other along the wetted port and starboard portions of the hull. The steps are inverted so that the bottom of each step extends laterally outboard of the hull in a generally horizontal direction, preferably with a slight downward angle to the horizontal in an inboard-to-outboard direction. The fin pockets are positioned in an upper one of the strake steps that is located approximately midway of the portion of the above the keel draft.

In other preferred designs, the fin pockets are positioned on non-strake hulls along a horizontal line located between 25% and 75% of the vessel draft above the keel. In these other preferred designs, as well as in the strake-step design, the hull is also flared immediately below the chine, this flared area comprising no more than the upper 25% of the boat's draft above the keel, and the deadrise angle of this flared area preferably being no more than 25°.

For very high speed boats, only one pair of fins is used, the fins being positioned close to the stern; and, for most smaller boat designs, my extra-deep-V hull is preferably equipped with only two sets of fins. However, more sets may be used, particularly on longer hulls, with the forward pockets being positioned both fore and aft of the vessel's center of balance. The fixed angular orientation of the fins greatly simplifies control of the boat. Since the lift angle is built in, the operator merely adds or subtracts fin surface to make control of lift smooth (i.e., uninterrupted) and easy, allowing even novice operators to achieve full and simple trim control at all speeds. Further, with the extra-deep-V design of my hull, the boat's keel and significant portions of the hull above the keel remain fully submerged at higher speeds when the retractable fins are being used to keep the boat on a plane. This important feature provides, remarkable stability and responsive handling.

As the fins are extended, the craft begins to lift, the amount of lift depending upon how much fin area is exposed. After the boat begins to plane, fin area can be reduced. The operator can also extend the fins in pairs or independently to trim the boat according to load, leveling it out to reduce drag. In rough seas, the bow can be raised when attacking an oncoming surf, or the stern can be raised in following seas. Since the fins can also be extended at low speeds, they provide hydraulic stability under such adverse conditions. Under calmer conditions, the fins provide lift that reduces the wetted surface of the hull, permitting higher speed and greater fuel economy. When docking, or when trailing the boat, the fins are fully retracted, and the boat can be docked and hauled in and out of the water in a conventional manner. Similarly, should the fins become weedbound, they can be readily cleaned by merely retracting them momentarily.

The invention has further advantages in that it may be used (i) with most conventional type mono-hull, catamaran, and tri-hull designs, including model boats, and (ii) with all types of known conventional power/-drive systems: inboard, outboard, gas, diesel, water-jet, sail, etc., to provide increased speed and economy as well as remarkable stability and safety in rough as well as smooth sea conditions.

DRAWINGS

FIGS. 1A, 1B, and 1C are schematic views of a boat hull according to my invention in a preferred step-straked deep-V embodiment represented, respectively, in a transom view, a side view, and a bottom view, the side view illustrating fins with a built-in stern-to-bow lift angle.

DETAILED DESCRIPTION OF PREFERRED EMBODIMENTS

Figure 1A:
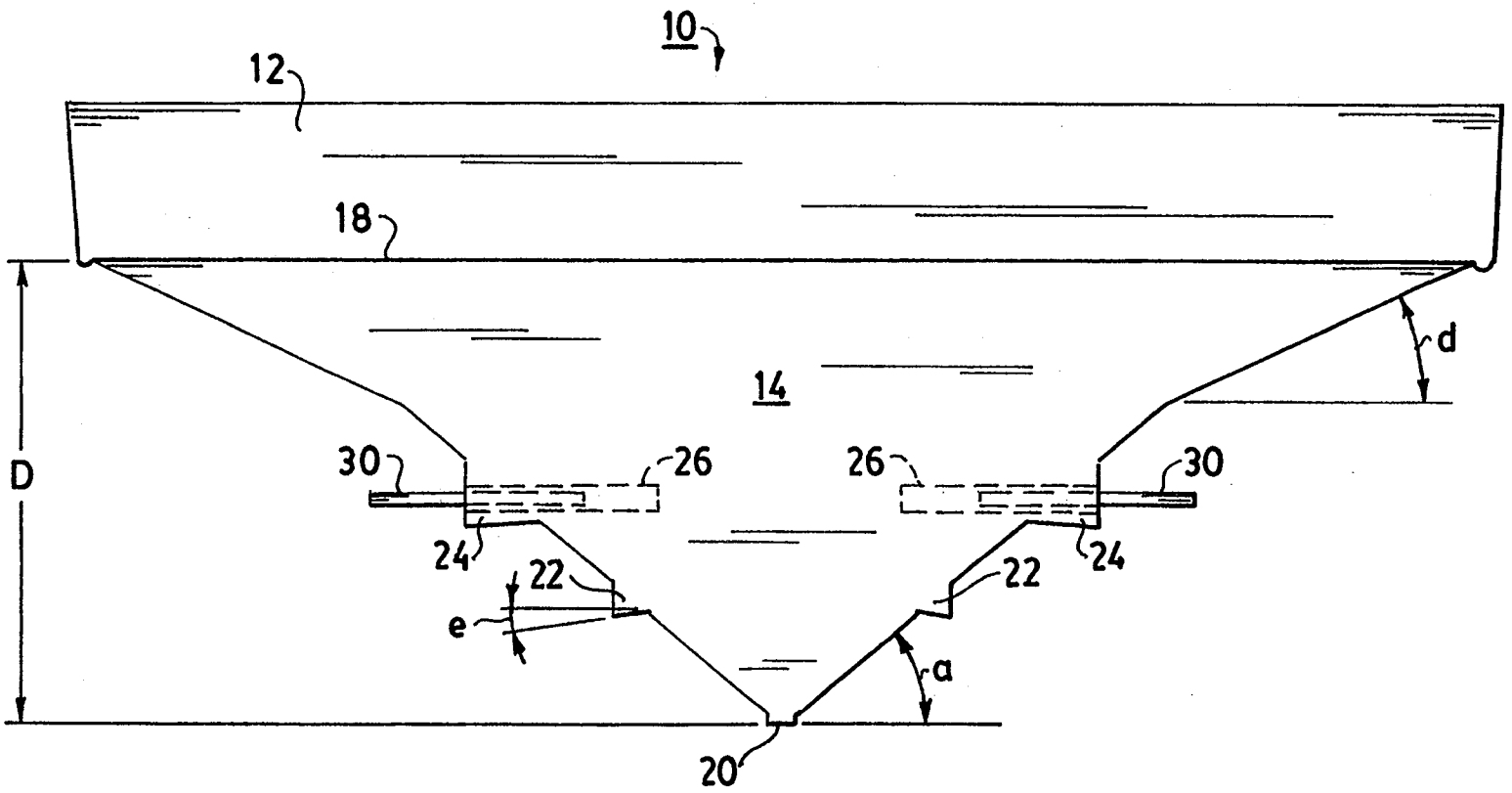
Figure 1B:
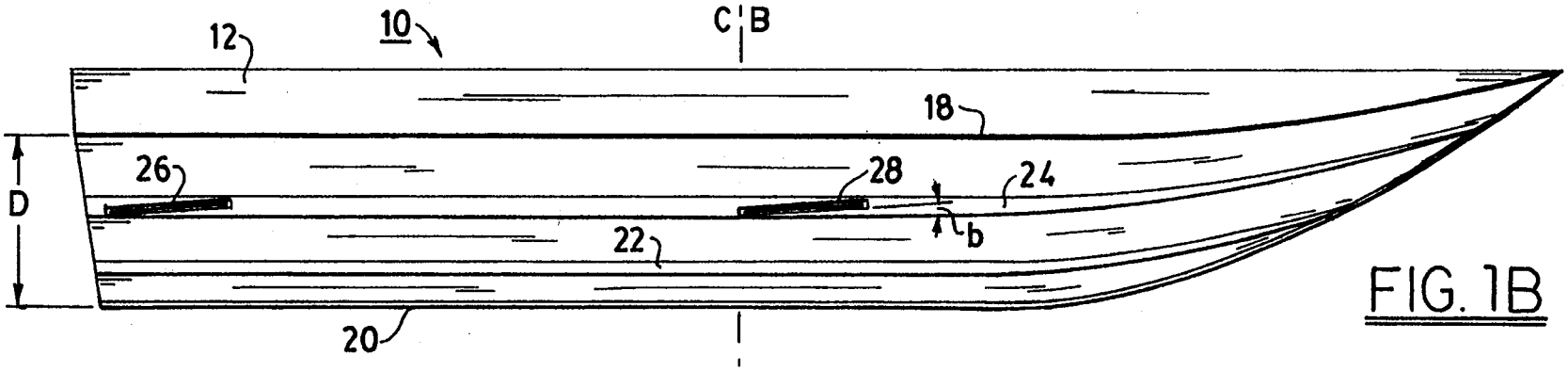
Figure 1C:
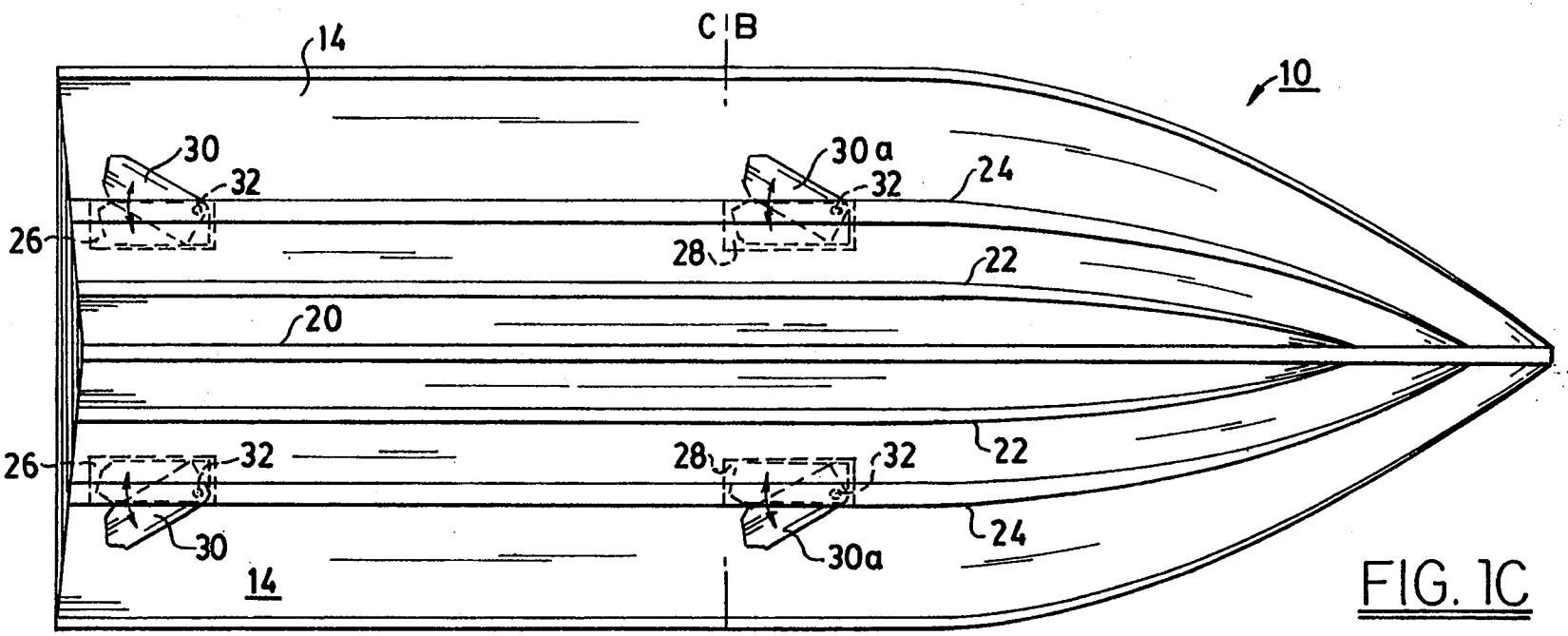

Referring to FIGS. 1A, 1B, and 1C, a preferred version of my modified deep-V hull 10 has an upper freeboard portion 12 and a lower wetted portion 14 having a maximum draft D measured vertically from the chine line 18 to the bottom of the keel 20. Hull 10 has a very steep initial deadrise angle a of between 30°–40°; and it includes two inverted strake steps 22, 24 which extend laterally outboard of the hull in a generally horizontal direction to wetted portion 14 from bow to stern, preferably with a slight downward angle e to the horizontal in an inboard-to-outboard direction. Strake steps 22, 24 are positioned, respectively, at approximately one-quarter and one-half of that portion of maximum draft D above the top of keel 20.

Upper strake step 24 is a little larger than lower step 22, and molded into its vertical portion are two pairs of fin pockets 26, 28, the pockets of each pair being disposed in similar positions on the starboard and port sides of hull 10, and the opening of each pocket being flush with the outside of hull 10. Aft-fin pockets 26 are positioned as close as is practicable to the stern of hull 10, while fore-fin pockets 28 are preferably positioned just forward of the thwartships plane of the boat's center of balance C. B.

Figure 2B:
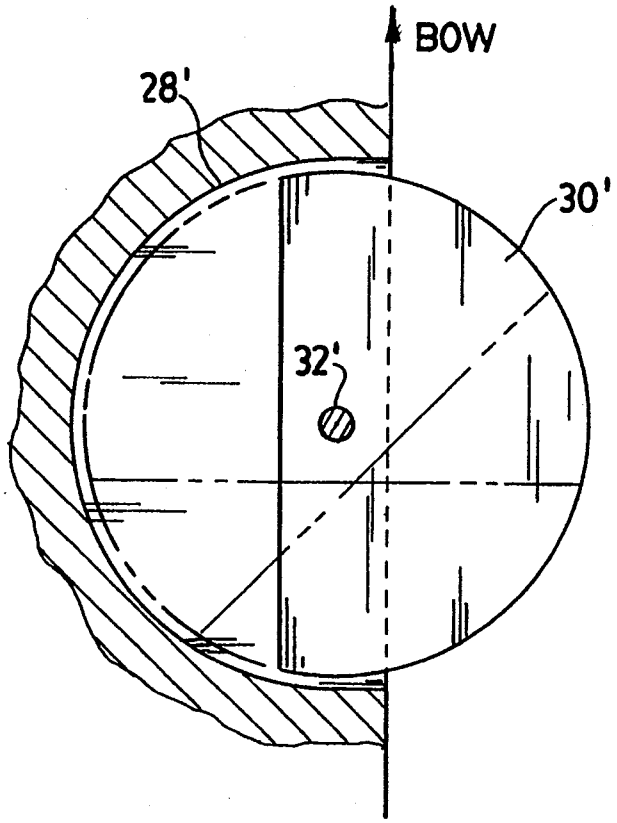
FIGS. 2A and 2B are schematic diagrams of fins with a delta shape and a semicircular shape, respectively, the fins being shown in full-line extended positions, and dotted-line partially-extended and retracted positions, relative to their respective pockets.
Figure 2A:
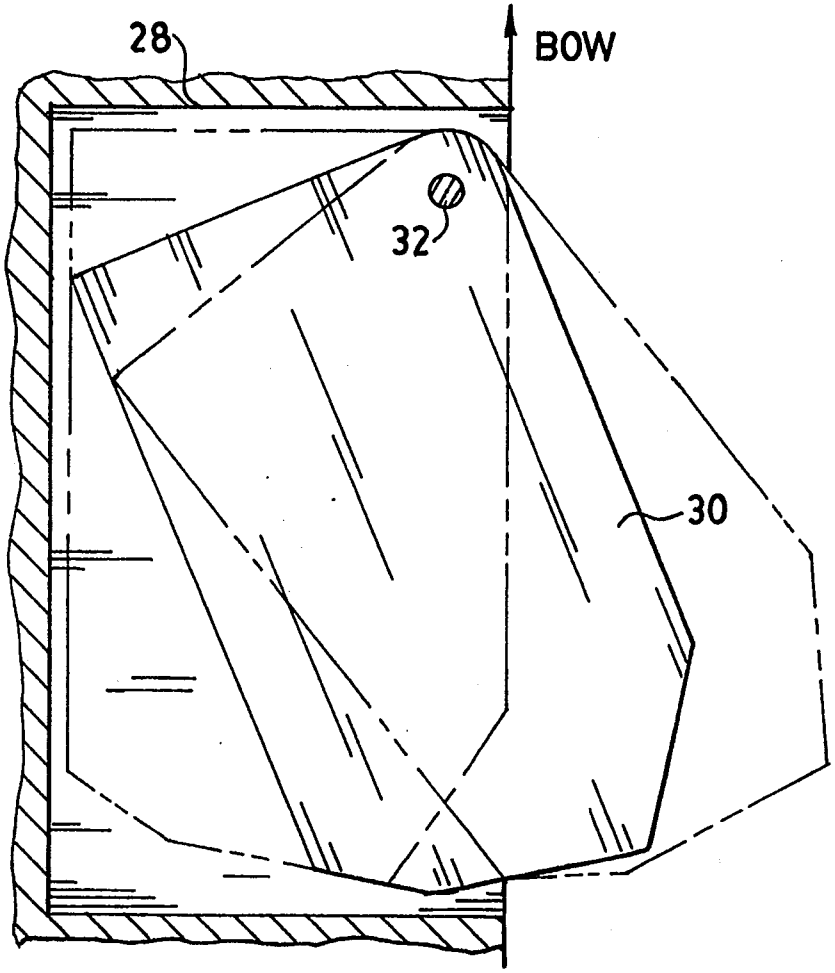

Each fin pocket 26, 28 supports a respective retractable fin **30, 30*a* which, in the preferred embodiment illustrated in FIG. 2A, is mounted for rotation about a pivot 32. Fin 30 is constructed so that, when it is rotated to its extended positions, its exposed portion extends cantilever fashion (i.e., without external support) laterally outboard of the hull and has a delta-wing shape, the narrow part of the wing pointing toward the bow of the boat. The solid lines show fin 30 in its fully-extended position, while the dotted lines show fin 30 in its half-extended and fully-retracted positions. As is best seen in FIG. 1C**, even when all of the fins are adjusted to their fully-extended position, the exposed area of the fins is quite small relative to the surface area of the hull. This feature, along with the fixed angular orientation of the fins, greatly facilitates the remarkable handling characteristics of my hull design as well as the simplicity with which its trim can be adjusted under all conditions of operation.

Figure 3:
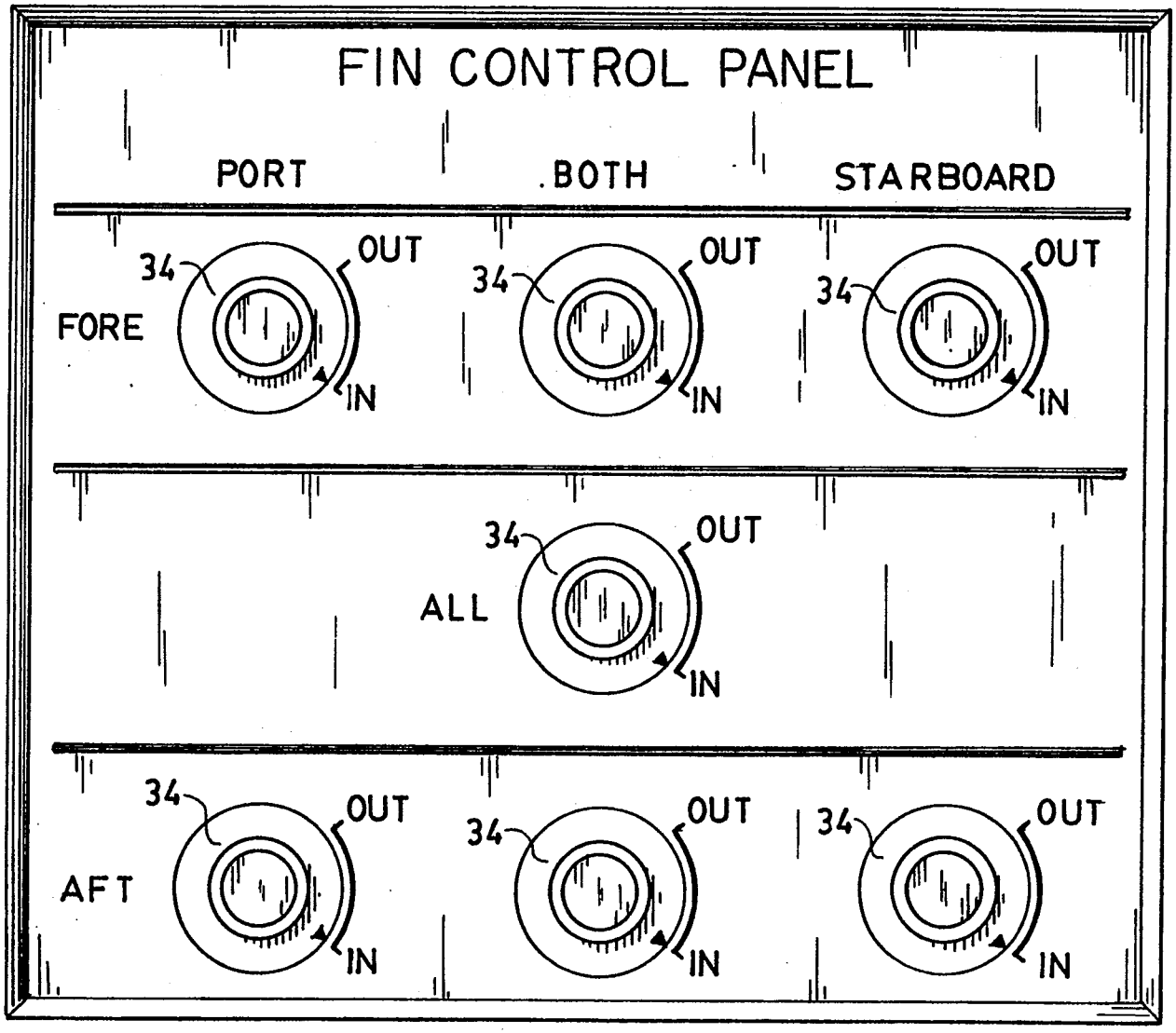
FIG. 3 represents a control panel for adjusting the position of the fins.

Preferably, each fin 30 can be adjusted to a continuum of positions between full retraction and full extension. A control panel (FIG. 3) is arranged to permit selective individual or simultaneous adjustment of the fins by the operator. Merely by adjusting one or more of the control levers 34, the operator can select the desired position of (a) each fin, individually; (b) the port and starboard fins of each pair, simultaneously; or (c) the port and starboard fins of both the fore and aft pairs, simultaneously. The extension mechanism (not shown) can be operated by any well-known conventional mechanical, electrical, or hydraulic system; and each fin is held in position by some appropriate well-known release mechanism (also not shown), e.g., an overdrive clutch, a shear pin, a pressure relief valve, etc., to minimize damage in the event the fin contacts some object.

The delta shape for fin 30 has been found to lessen drag and to reduce the possibility of becoming weedbound. In this regard, should a fin become weedbound, the weeds can be easily removed by a momentary retraction of the fin into its respective pocket.

However, other fin shapes may also be used. FIG. 2B illustrates a "partial-disc" shape fin 30', showing its fully-extended position in solid lines and, in dotted lines, showing it half extended, one-quarter extended, and fully retracted within pocket 28'. Rectangular fins can be used as well, preferably in a swept-back orientation when fully extended. In all of these various fin embodiments, the fins have a foil configuration.

Fin pockets 26, 28 support fins **30, 30*a* in predetermined fixed lift-angle orientations. In most preferred embodiments, the fins are oriented relative to hull 10 so that the forwardmost part of each fin is higher than the sternmost part of the same fin by an angle b of 6°–10° above the horizontal. This can be best seen in FIG. 1B**.

As indicated above, for higher speed boats, the fin pockets may also be constructed to orient the fins with a built-in inboard-outboard lift angle. In such embodiments, the outboard part of each fin is higher than the inboard part of the same fin. This can best be seen in FIG. 4 where pockets **26*b* are positioned just below mid-draft of another embodiment of my extra-deep-V hull that does not include strake steps. The outboard part of each fin 30*b*** is higher than the inboard part of the same fin by an angle c of 10°–25° above the horizontal.

Figure 4:
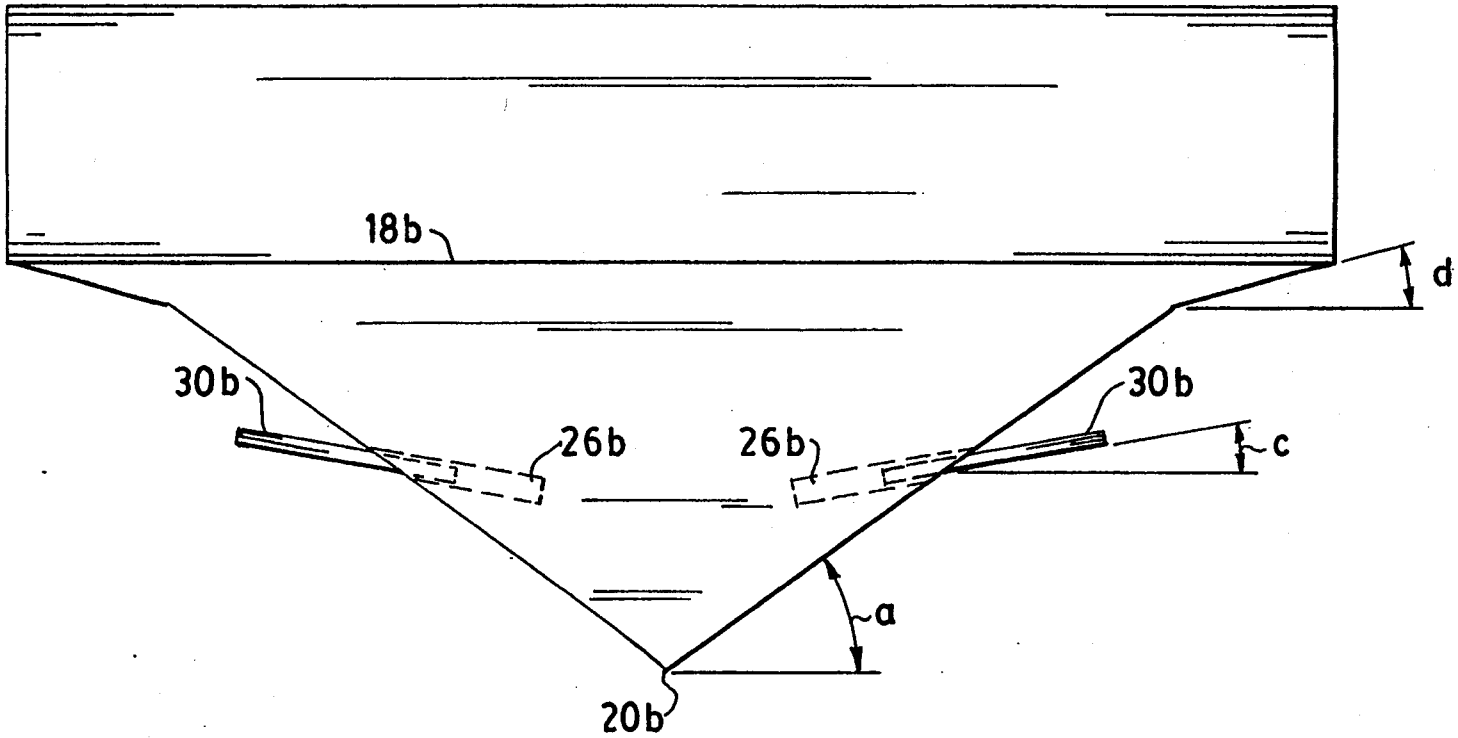
FIG. 4 is a schematic transom view of another mono-hull embodiment of the invention, showing fins with a built-in inboard-to-outboard lift angle.

FIGS. 1A and 4 illustrate another feature of my invention. In combination with my extra steep initial deadrise angle a of 30°–40°, it is preferred that the upper 25% of the wetted hull (just below chine line **18, 18*a*) include a flared portion having a shallower deadrise angle d of 15°–25°. This decreased angle just below the chine provides greater stability, while permitting the wetted area to be quickly reduced for less drag when the hull is initially lifted as speed is increased. With variably-sized strake steps 22, 24, lower step 22 has less lift area than upper step 24, and the flared area just below chine line 18** has a much greater lift area. Therefore, when the hull reenters the sea after being lifted by the fins or by a wave, the gradually-ratioed lift from keel to chine provides a very smooth reentry.

Figure 5:
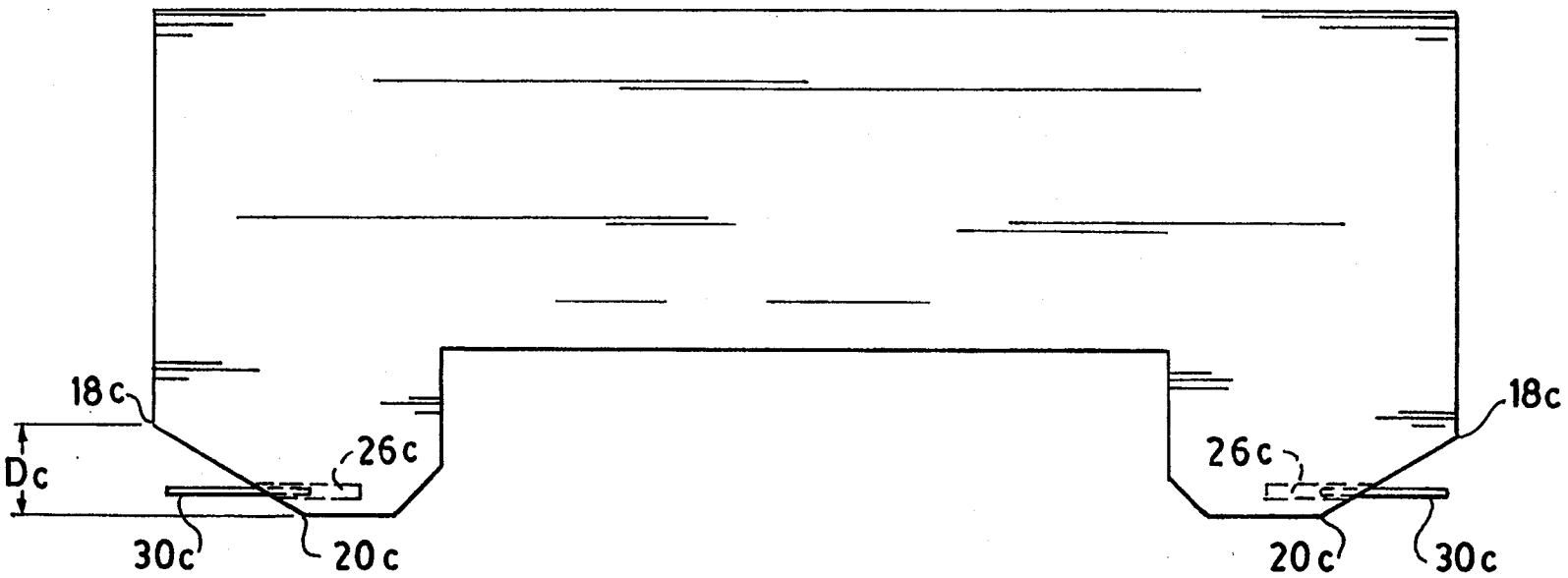
FIG. 5 is a schematic transom view of the invention incorporated in a catamaran hull.

As stated above, my invention can be used with catamaran and tri-hulls as well as mono-hulls, and it is compatible with all types of propulsion systems. FIG. 5 is a schematic transom view of the invention applied to a catamaran hull. The outboard surfaces of the hull are designed with a relatively steep deadrise from keels **20*c* to chine line 18*c*, and fins 30*c* are supported in aft-pockets 26*c* which are mounted on the outboard portions of the hull and positioned above keel 20*c*** at approximately one-third maximum draft Dc.

Figure 6:
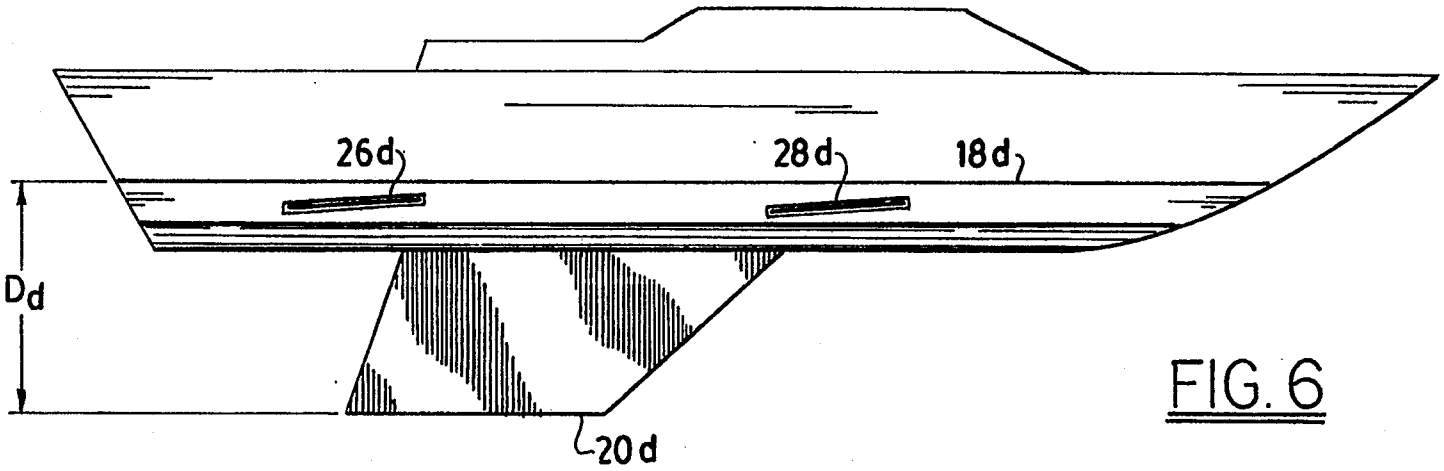
FIG. 6 is a schematic side view of the invention incorporated in a sail boat hull.

A sailboat hull, modified according to the invention, is shown in FIG. 6 with fin pockets **26*d*, 28*d*** positioned along the upper wetted hull at approximately 25% of maximum draft Dd.

Figure 7:
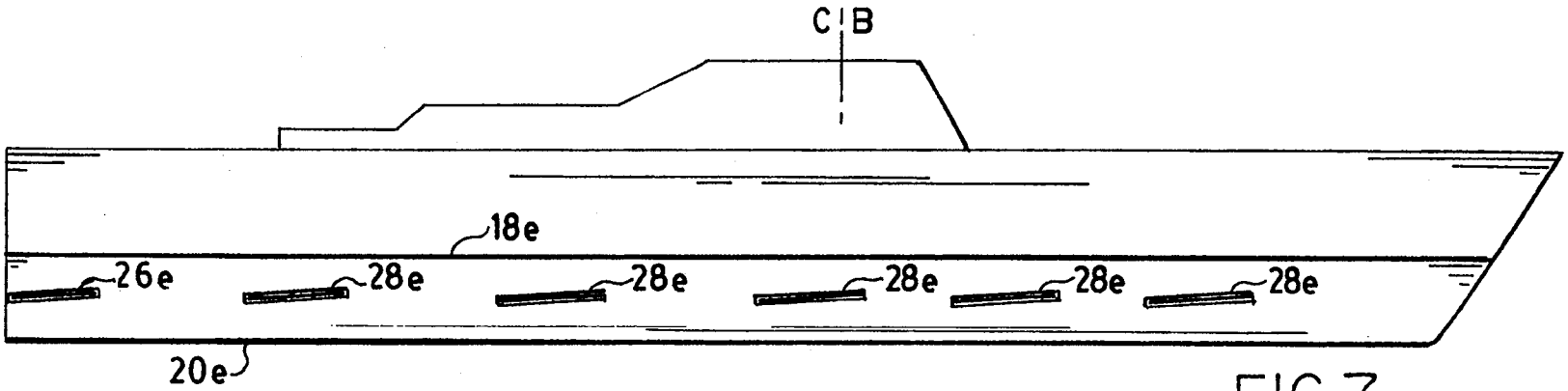
FIG. 7 is a schematic side view of the invention incorporated in the hull for a larger boat.

FIG. 7 shows the invention applied to the hull for a larger boat (e.g., 50-foot to 125-foot), with a plurality of forward-pockets **28*e* positioned forward of aft-pockets 26*e*** to provide a lift appropriate for its weight.

In spite of dire warnings received from professional model builders that the V of my hull design was too deep for practical use, I made and tested a one-quarter size model (5.75 feet long) of an embodiment similar to that shown schematically in FIG. 4. I have tested and videotaped the performance of this one-quarter scale model operating on Fairhaven (Little Sodus) Bay on Lake Ontario in one-foot waves (equivalent to operating a 23-foot boat in four-foot waves), and its performance is quite amazing: (a) the boat shows unusual stability at low speed with the fins extended (exhibiting remarkably less pitching than would be expected); (b) it appears to rise onto a plane much faster than known deep-V hulls; (c) at higher speeds, it maintains its plane with very slightly extended fins, and cuts quite easily through the very rough water; and (d) most remarkably, it turns while planing at high speeds with very little skidding, remaining quite square (i.e., does not exhibit the usual yaw) and not dropping off plane even in tight turns. In short, the low center of gravity of my extra-deep-V provides excellent balance and stability at all times, particularly when operating with the fins, while requiring less power for overall operation than conventional hulls.

I claim:

1. A boat hull design with a maximum draft measured from the bottom of the keel to the chine, said hull design comprising:

a wetted portion with outboard surfaces extending above the keel having a deep-V shape with a deadrise of at least 24° from the top of the keel upward toward the chine;

at least one pair of retractable wing-like fins positioned in respective pockets along said outboard surfaces of said wetted portion, said fins being extendable, respectively, in cantilever fashion without external support from opposite sides of the hull at a predetermined distance above said keel, each said fin being selectively and continuously adjustable between (a) a fully-extended position wherein a portion of the fin is positioned Within said respective pocket while the remaining part of the fin extends laterally outboard of the hull above the keel for a predetermined maximum distance, and (b) a fully-retracted position wherein all of said fin is positioned within its said respective pocket;

at least one of said fin pairs being positioned in proximity to the stern; and said fins each having a fixed angular orientation relative to said outboard surfaces of the hull so that, when said fins are positioned in said fully-extended position, the keel and significant portions of said hull above the keel remain in the water even when the boat is planing; and so that, as said fins are selectively and continuously adjusted to modify the area of each said fin that is exposed laterally outboard of the hull, uninterrupted trim control can be achieved at all speeds.

2. The hull design according to claim 1 wherein said deep-V shape has an initial deadrise from the keel upward toward the chine with an angle of at least 30°.

3. The hull design according to claim 1 wherein the part of each said fin that extends laterally outboard of the hull has a partial-disc shape.

4. The hull design according to claim 1 wherein the fins of each pair can be adjusted to any one of said selected positions at the same time.

5. The hull design according to claim 1 wherein each fin can be adjusted to any one of said selected positions individually.

6. The hull design according to claim 1 wherein said fin pockets are positioned along the hull at respective distances above the keel representing the same relative percentage of said maximum draft.

7. The hull design according to claim 6 wherein said fin pockets are positioned along the hull at respective distances above the keel between 25% and 75% of the portion of said maximum draft above the keel.

8. The hull design according to claim 1 having another of said fin pairs positioned forward of said stern pair.

9. The hull design according to claim 8 having a center of balance and wherein said forward pair of fins is positioned forward of said center of balance.

10. The hull design according to claim 1 wherein at least one pair of said fins is oriented relative to said hull so that the forwardmost part of each fin is higher than the sternmost part of the same fin by an angle of 6°–10° above the horizontal.

11. The hull design according to claim 1 wherein at least one pair of said fins is oriented relative to said hull so that the outboard part of each fin is higher than the inboard part of the same fin by an angle of 10°–25° above the horizontal.

12. The hull design according to claim 1 further comprising:

at least one strake step formed along each said outboard surface of said wetted portion, said strake step being inverted so that the bottom of said step extends laterally outboard of the hull.

13. The hull design according to claim 1 further comprising:

at least two strake steps formed one above the other along each said outboard surface of said wetted portion, said strake steps being inverted so that the bottoms of said steps extend laterally outboard of the hull; and said fin pockets are positioned along an upper one of said strake steps.

14. The hull design according to claim 13 wherein said fin pockets are positioned in an upper one of said strake steps which is located approximately midway of the portion of said maximum draft above the keel.

15. The hull design according to claim 2 wherein said outboard surfaces of said wetted portion of the hull further comprise:

a flared area immediately below said chine, said flared area having a deadrise angle less than said initial deadrise angle.

16. The hull design according to claim 15 wherein said flared area comprises no more than the upper 25% of the portion of said maximum draft above the keel and the deadrise angle of said flared area is no more than 25°.

17. The hull design according to claim 1 wherein the part of each said fin that extends laterally outboard of the hull has a delta-wing shape.

* * * * *